US012584369B2

(12) United States Patent
von Gynz-Rekowski et al.

(10) Patent No.: US 12,584,369 B2
(45) **Date of Patent: *Mar. 24, 2026**

(54) SEALING SYSTEM AND METHOD

(71) Applicant: Workover Solutions, Inc., Imperial, PA (US)

(72) Inventors: Gunther HH von Gynz-Rekowski, Montgomery, TX (US); Brandon Kaderka, Katy, TX (US); Kevin J. Rudy, Tomball, TX (US)

(73) Assignee: Workover Solutions, Inc., Imperial, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/766,058

(22) Filed: Jul. 8, 2024

(65) Prior Publication Data

US 2024/0360736 A1 Oct. 31, 2024

Related U.S. Application Data

(63) Continuation of application No. 18/136,723, filed on Apr. 19, 2023, now Pat. No. 12,104,449.

(51) Int. Cl.

| | |
|---|---|
| ***E21B 33/12*** | (2006.01) |
| ***E21B 33/13*** | (2006.01) |
| ***E21B 34/14*** | (2006.01) |

(52) U.S. Cl.

CPC ..... *E21B 33/12* (2013.01); *E21B 33/13* (2013.01); *E21B 34/14* (2013.01); *E21B 2200/08* (2020.05)

(58) Field of Classification Search

CPC ..... E21B 34/063; E21B 33/12; E21B 34/10; E21B 34/14; E21B 2200/06; E21B 34/06; E21B 33/16; E21B 33/13; E21B 33/134

See application file for complete search history.

(56) References Cited

U.S. PATENT DOCUMENTS

| | | | |
|---|---|---|---|
| 3,776,258 | A | 12/1973 | Dockins, Jr. |
| 4,796,704 | A | 1/1989 | Forrest et al. |
| 6,472,068 | B1 | 10/2002 | Glass et al. |

(Continued)

FOREIGN PATENT DOCUMENTS

CA 3153401 A1 * 5/2021 ..... E21B 34/063

OTHER PUBLICATIONS

English translation of CN 113924405. (Year: 2022).*

(Continued)

*Primary Examiner* — Zakiya W Bates

(74) *Attorney, Agent, or Firm* — Jones Walker LLP

(57) ABSTRACT

A sealing system for fluidly sealing a portion of a wellbore including a housing, a rupture disc disposed within a housing inner bore, and a plug disposed within the housing inner bore. The rupture disc includes a base and a central portion, which extends across the housing inner bore to fluidly seal the housing inner bore in a sealed state. The plug fluidly seals the housing inner bore in the sealed state. The plug is disposed an axial distance from the rupture disc in the sealed state. In some embodiments, a sleeve is disposed within the housing inner bore. A central bore of the sleeve retains the plug in the sealed state. Upon a release event, the plug is released from the sleeve. The release of the plug triggers a rupture event, which fractures the rupture disc. The plug clears rupture disc fragments.

28 Claims, 13 Drawing Sheets

(56) References Cited

U.S. PATENT DOCUMENTS

| | | | |
|---|---|---|---|
| 7,806,189 | B2 | 10/2010 | Frazier |
| 9,382,778 | B2 | 7/2016 | Frazier |
| 9,534,463 | B2 | 1/2017 | Frazier |
| 9,739,114 | B2 | 8/2017 | Frazier |
| 10,107,070 | B2 | 10/2018 | Yong et al. |
| 10,184,319 | B2 | 1/2019 | Hardesty et al. |
| 10,458,201 | B2 | 10/2019 | Frazier |
| 10,871,053 | B2 | 12/2020 | Frazier |
| 11,098,556 | B2 | 8/2021 | Frazier |
| 11,965,395 | B1 | 4/2024 | von Gynz-Rekowski et al. |
| 2011/0247833 | A1 | 10/2011 | Todd et al. |
| 2012/0168228 | A1 | 7/2012 | Giroux et al. |
| 2014/0216756 | A1 | 8/2014 | Getzlaf et al. |
| 2014/0332233 | A1 | 11/2014 | Walton et al. |
| 2015/0369010 | A1 | 12/2015 | Themig et al. |
| 2016/0069462 | A1 | 3/2016 | Petrowsky |
| 2017/0247978 | A1 | 8/2017 | Budler |
| 2018/0320488 | A1 | 11/2018 | Campbell et al. |
| 2021/0381337 | A1 | 12/2021 | Frazier |
| 2023/0131218 | A1 | 4/2023 | Werries et al. |

OTHER PUBLICATIONS

Odfjell Well Services, "RDS Rupture Disc Sub," https://www.odfjellwellservices.com/well-intervention-services/wellbore-clean-up/rds-rupture-disc-sub/#:~:text=Share%3A,rupture%20discs%20to%20provide%20redundancy, accessed on Dec. 1, 2022.

Nine Energy Service, "Single MagnumDiskTM," https://nineenergyservice.com/completions-technologies/completion-barrier-valves/single-magnumdisk, accessed on Dec. 1, 2022.

Schlumberger, "KickStart Rupture disc valve" (2019).

International Search Report and Written Opinion, mailed Apr. 19, 2024, for corresponding International Patent Application No. PCT/US2024/013671.

* cited by examiner

SEALING SYSTEM AND METHOD

CROSS-REFERENCE TO RELATED APPLICATIONS

This application is a continuation of and claims priority to U.S. patent application Ser. No. 18/136,723, filed on 19 Apr. 2023, which is incorporated by reference herein.

BACKGROUND

In the process of drilling and producing oil and gas wells, certain zones within the wellbore are isolated or sealed from surrounding zones or from the surface of the wellbore. After drilling a wellbore, a casing is typically set along the outer surface of the wellbore. Bridge plugs, packers, and/or other sealing devices are then set within the casing to isolate defined zones within the wellbore. For example, the isolated zone may be created between 5,000 and 10,000 feet downstream from the surface. The sealing devices will fluidly seal the isolated zone from other zones such that only the isolated zone will be in fluid communication with the surface of the wellbore. In other words, the sealing devices prevent fluid communication between all other zones and the surface of the wellbore. The casing in the isolated zone is perforated to allow fluid communication between the subterranean formation and the isolated zone of the wellbore and ultimately the surface of the wellbore.

Rupture discs are sometimes used in sealing devices for fluid isolation of wellbore zones. Conventional rupture discs include smooth arched surfaces, which allow for a greater pressure rating on one side of the rupture disc than the other side. When operations are completed in the isolated zone, the rupture disc may be broken to allow fluid communication between other zones and the surface of the wellbore. The breaking of the rupture disc creates fragments of unpredictable size and shape. Often, the disc fragments are large and create problems, such as blocking openings or presenting difficulty in removing the disc fragments from the wellbore.

BRIEF DESCRIPTION OF THE DRAWING VIEWS

DETAILED DESCRIPTION OF SELECTED EMBODIMENTS

Disclosed herein is a sealing system including a frangible rupture disc and a plug selectively retained by a sleeve. The plug, which may be dissolvable or non-dissolvable, is configured to be selectively released from the sleeve, which causes the rupture disc to fracture into fragments. The plug is also configured to clear the fragments of the rupture disc from the rupture disc housing. The sealing system may be used in underbalanced wells.

FIGS. 1-13 illustrate one embodiment of the sealing system disclosed herein, with many other embodiments within the scope of the claims being readily apparent to skilled artisans after reviewing this disclosure.

Figure 1:
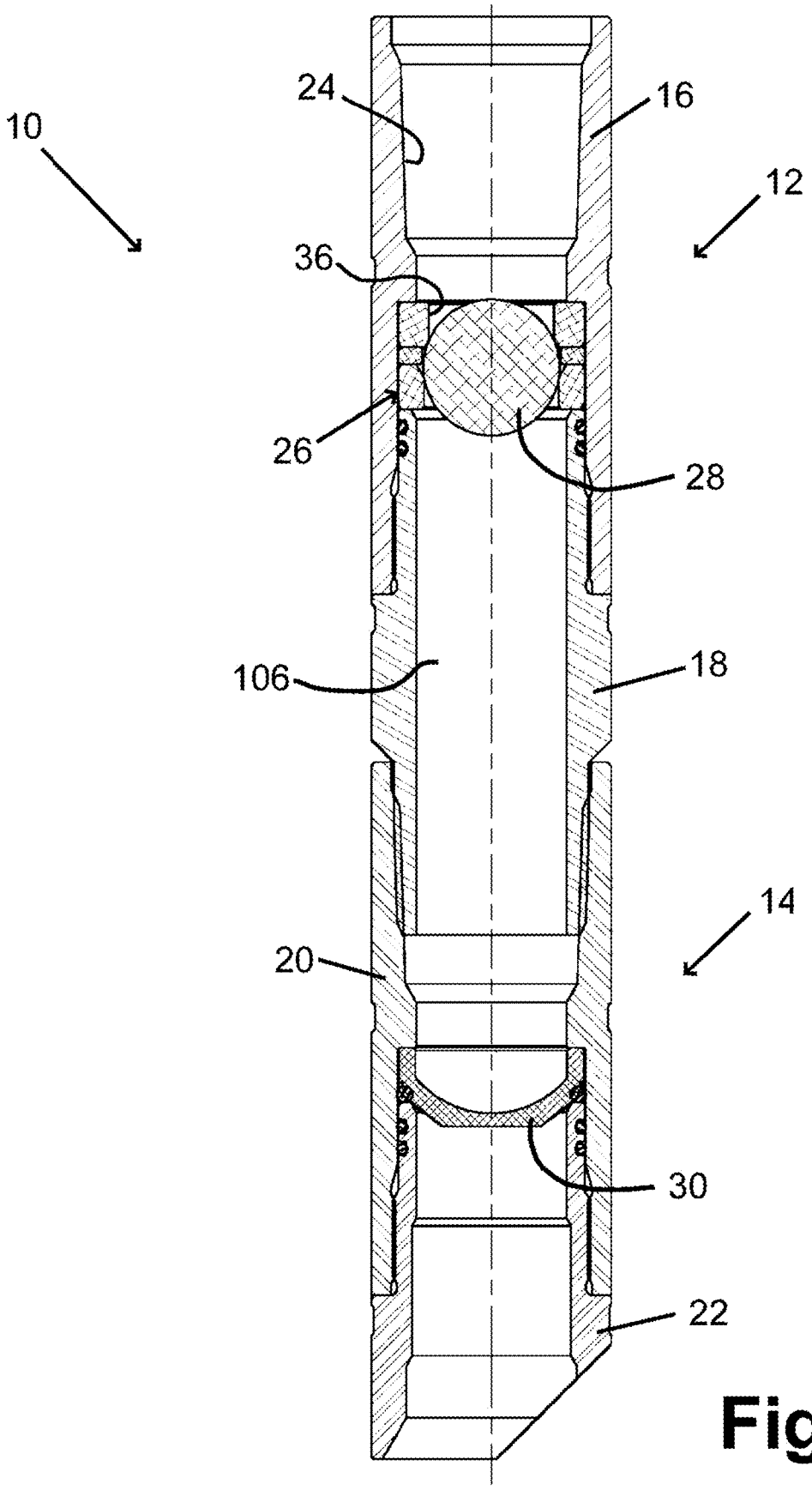
FIG. 1 is a sectional view of a sealing system in a sealed state.

With reference to FIG. 1, sealing system 10 includes plug portion 12 and rupture disc portion 14. A housing of sealing system 10 includes housing segments 16, 18, 20, and 22. The housing includes housing inner bore 24 extending through all housing segments 16, 18, 20, and 22. System 10 also includes sleeve 26 and plug 28 disposed within housing inner bore 24 in plug portion 12 and rupture disc 30 disposed within housing inner bore 24 in rupture disc portion 14. In some embodiments, plug 28 may have a spherical shape, a cube shape, a cylindrical shape, a cone shape, a wedge shape, a disc shape, or any other shape configured to selectively seal the central bore of sleeve 26. Plug 28 may be formed of any soluble or dissolvable material that is capable of being dissolved or otherwise broken down by at least one fluid, such as dissolvable materials such as magnesium, zinc alloy, polylactic acid (PLA), or polyvinyl alcohol (PVA). Alternatively, plug 28 may be formed of any non-dissolvable material, such as ceramics or glass. In this position, plug 28 may be separated from rupture disc 30 by an axial distance of about 0.5 inch to about 12 inches, more preferably about 2 inches to about 10 inches. In the sealed state illustrated in FIG. 1, sleeve 26 is also separated from rupture disc 30 by the same axial distance.

Figure 2:
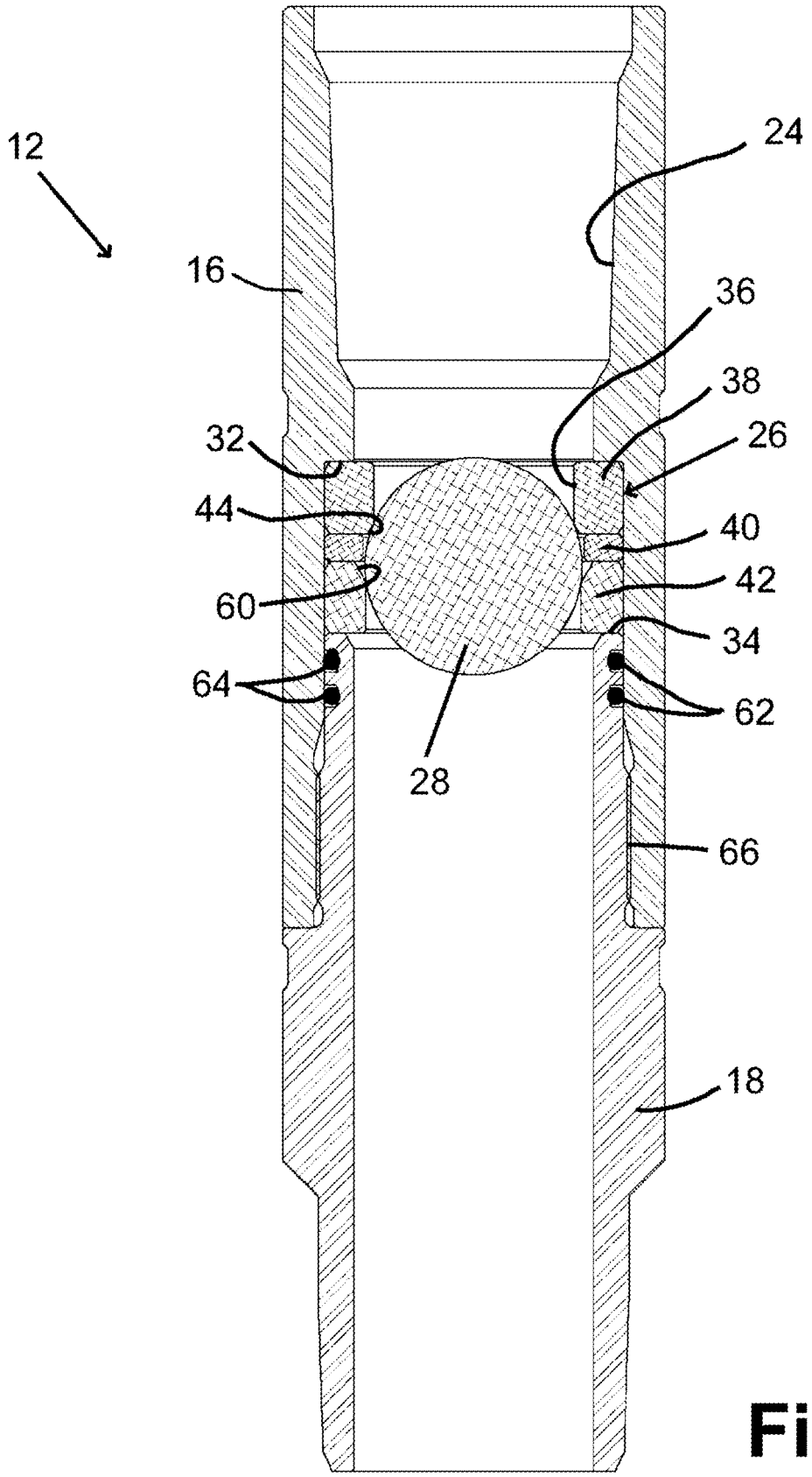
FIG. 2 is a sectional view of a plug portion of the sealing system.
Figure 3:
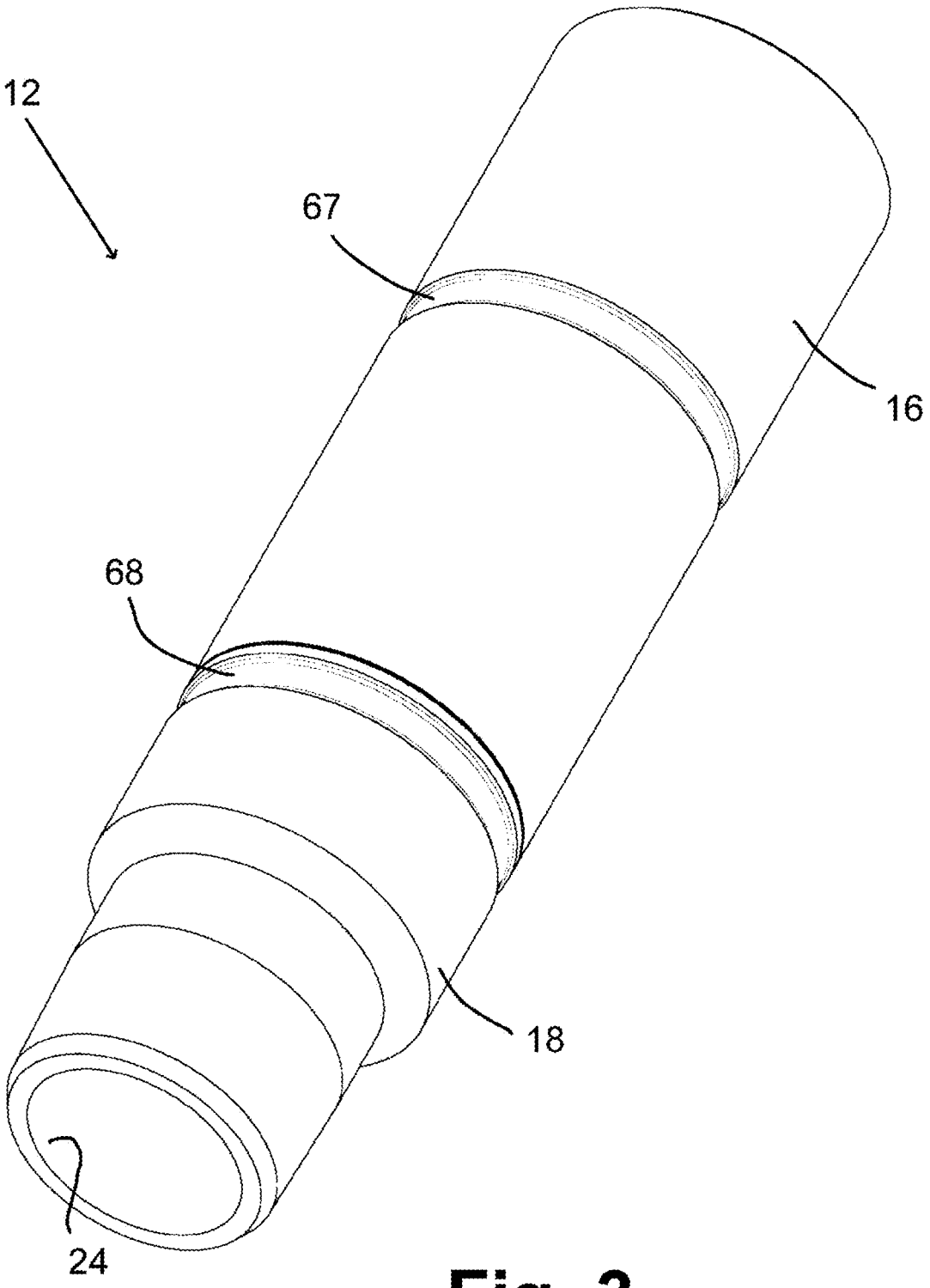
FIG. 3 is a perspective view of the plug portion.

Referring now to FIGS. 1-3, sleeve 26 of plug portion 12 is secured within housing inner bore 24. In some embodiments, sleeve 26 is disposed within an expanded diameter portion of housing inner bore 24. For example, in the illustrated embodiment, sleeve 26 may be disposed within an expanded diameter portion of housing inner bore 24 defined by downward facing shoulder 32 of housing segment 16 and upper end 34 of housing segment 18. Sleeve 26 includes sleeve central bore 36. In some embodiments, sleeve 26 may include an assembly of two or more rings. For example, sleeve 26 may include upstream ring 38, trim spacer 40, and downstream ring 42. Rings 38 and 42 and trim spacer 40 may be configured to retain plug 28. In some embodiments, upstream ring 38 may have an inner diameter that is smaller than an outer diameter or outer dimension of plug 28. Trim spacer 40 may have an inner diameter that is larger than the outer diameter or outer dimension of plug 28. Downstream ring 42 may have an inner diameter that is slightly smaller than an outer diameter or outer dimension of plug 28.

In addition to the inner diameter configuration of rings 38 and 42 and trim spacer 40, one or more of the rings in sleeve 26 may include a retainer, and at least one retainer may form a seat. For example, upstream ring 38 and downstream ring 42 may each include a retainer, and the retainer of downstream ring 42 may form a seat for plug 28, such as a ball seat for a dissolvable or non-dissolvable ball. In the illustrated embodiment, a retainer of upstream ring 38 includes tapered shoulder 44, and a retainer of downstream ring 42 includes tapered shoulder 60. Tapered shoulder 44 of upstream ring 38 may be sized and configured to retain plug 28 by preventing plug 28 from traveling in an upstream direction beyond tapered shoulder 44 in a sealed state of system 10 shown in FIG. 1. In this way, tapered shoulder 44 is an upstream retainer for the plug 28. Tapered shoulder 60 of downstream ring 42 may be sized and configured to retain plug 28 by preventing plug 28 from traveling in a downstream direction beyond tapered shoulder 60 in the sealed state of system 10. In this way, tapered shoulder 60 is a downstream retainer, also referred to as a seat, for retaining plug 28. Together, tapered shoulders 44 and 60 retain plug 28 in sleeve central bore 36 in the sealed state. In this state, sleeve 26 and plug 28 extend across housing inner bore 24 to provide a fluid seal therein. In other embodiments, sleeve 26 may include an upstream retainer, a downstream retainer, or both an upstream retainer and a downstream retainer in only one ring, with or without other rings. As used herein, "tapered" means that a referenced surface is not parallel to a central axis. In other embodiments, the downstream retainer is formed of a convex surface or a concave surface.

One or more seals 62 may be positioned in one or more recesses 64 to fluidly seal the housing inner bore 24 at the connection point between segments 16 and 18. Housing segments 16 and 18 may be secured together at interface 66, which may include a threaded inner surface of segment 16 and a threaded outer surface of segment 18. In other embodiments, housing segments 16 and 18 may be secured by any fastening mechanism as readily understood by skilled artisans. In some embodiments, one or more housing segments may include a circumferential recess in the outer surface. For example, circumferential recess 67 may extend around the outer surface of housing segment 16, and circumferential recess 68 may extend around the outer surface of housing segment 18. Identifying information about the tool or job number may be stamped into recesses 67 and 68 where the outer diameter reduction reduces the wear on the stamped information.

Plug portion 12 may be configured to release plug 28 from sleeve 26 in response to a release event. The release event may be application of an upstream pressure within housing inner bore 24 upstream of sleeve 26 that meets or exceeds a release pressure value in the downstream direction on plug 28. The release pressure value may be the pressure required to overcome the frictional forces between plug 28 and a downstream retainer, such as tapered surface 60 of sleeve 26. The release pressure valve may be the pressure required to plastically deform plug 28 in such a way that the new outer diameter of the plug is equal or smaller than the inner diameter of ring 42. In some embodiments, the release pressure value may be in the range of 500 psi and 2,000 psi. In certain embodiments, the release pressure value may be less than or equal to 50% of a yield stress value of housing segment 16. For example, the housing segments of sealing system 10 may be formed of carbon steel, alloys, nickel steel, high yield steel, titanium, beryllium copper, and the release pressure value may be in the range of 500 psi to 2,000 psi. In other embodiments, the release pressure value may be 95% or less of an overpull to failure in the weakest cross-sectional area of the housing. As used herein, "overpull to failure" is the maximum pull that can be exerted on stuck drill pipe without causing failure in the drill string. Alternatively, the release event may be a mechanical or physical force exerted in a downstream direction on an upstream surface of plug 28. In embodiments in which plug 28 is formed of a dissolvable material, the release event may be introducing a fluid that dissolves or otherwise breaks down the plug 28. As used herein, "release event" means an occurrence that causes plug 28 to be released from sleeve 26. Once released from sleeve 26, the plug 28 may travel in a downstream direction into intermediate space 106. In some embodiments, the outer diameter or outer dimension of the plug 28 is less than the inner diameter of housing inner bore 24 such that plug 28 moves in the downstream direction more easily when released from sleeve 26.

Figure 4:
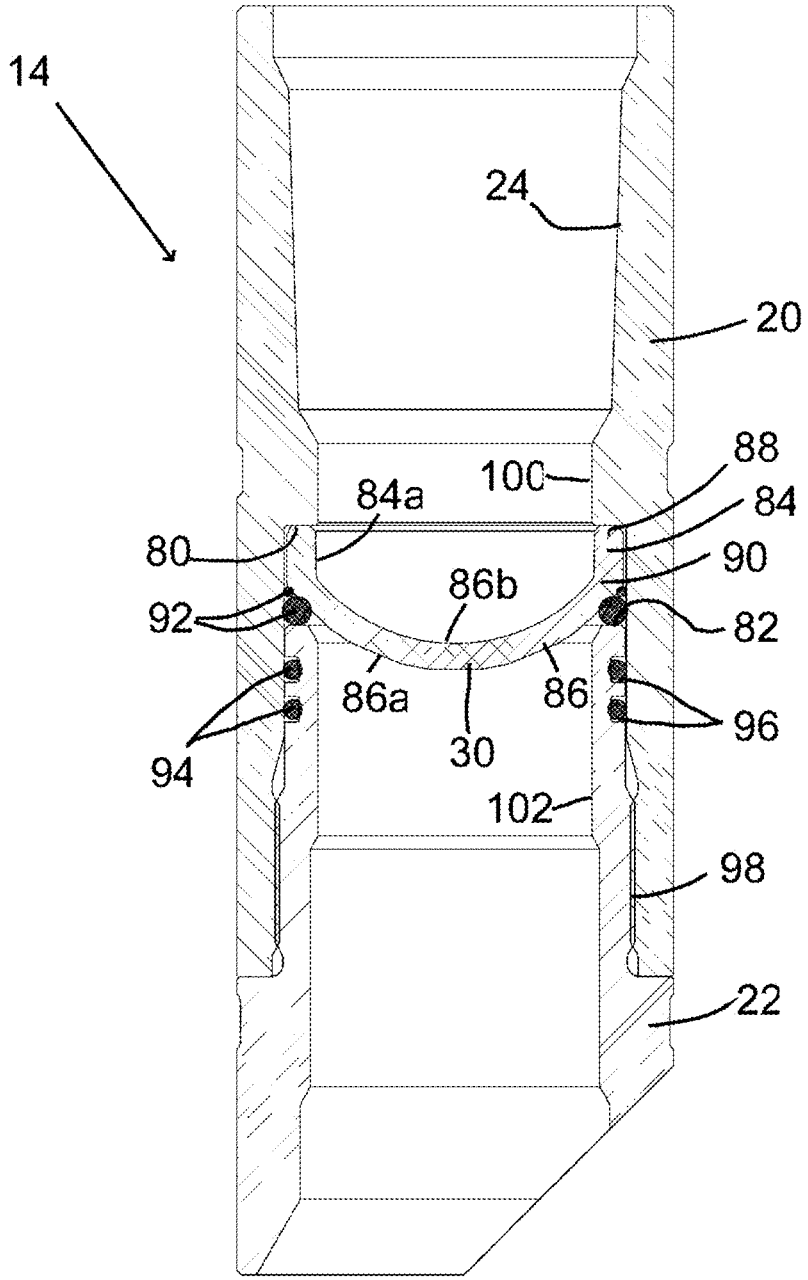
FIG. 4 is a sectional view of a rupture disc portion of the sealing system.
Figure 5:
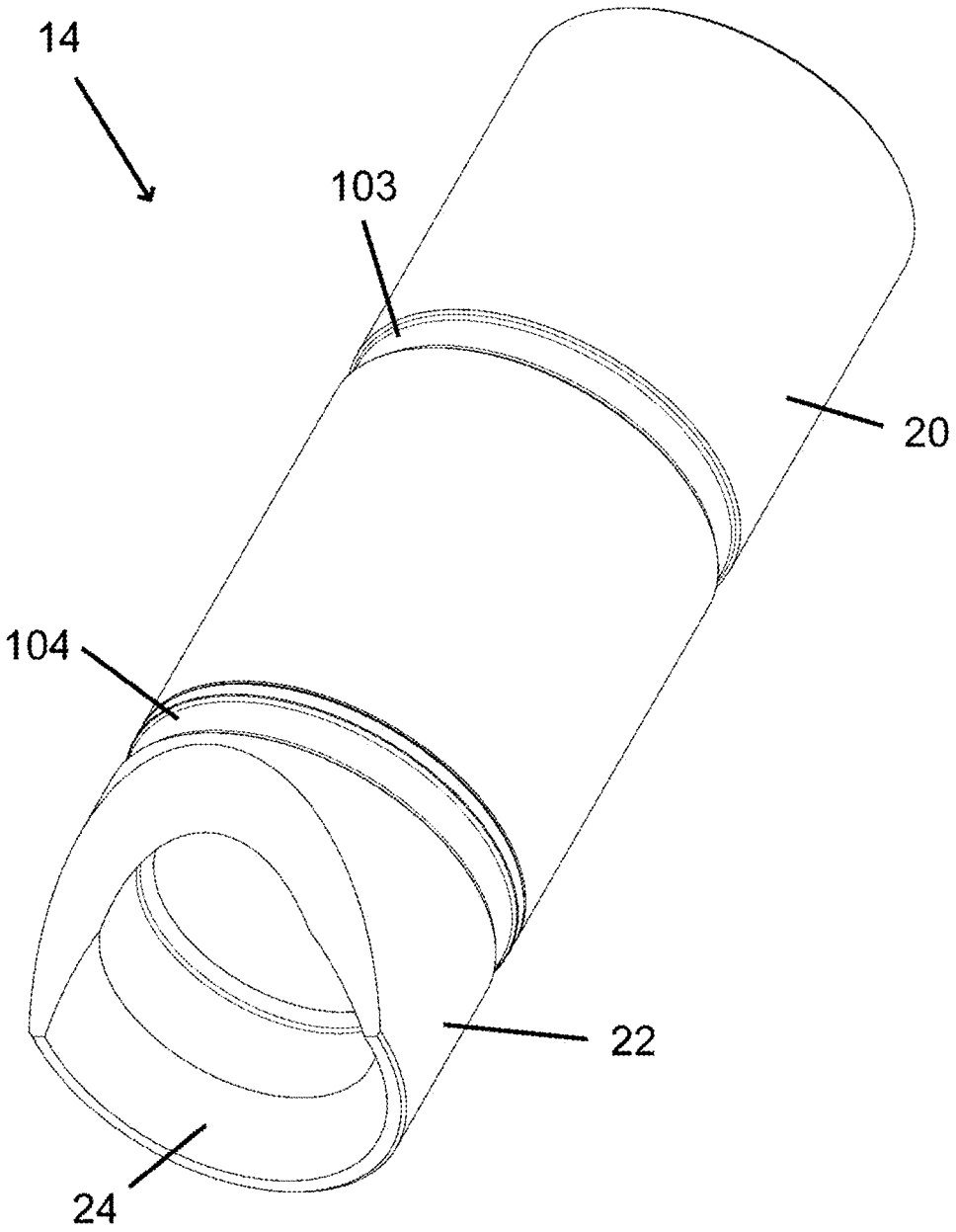
FIG. 5 is a perspective view of the rupture disc portion.

With reference to FIGS. 1, 4, and 5, rupture disc 30 of disc portion 14 is secured within housing inner bore 24. In some embodiments, housing inner bore 24 includes an expanded diameter portion configured to house rupture disc 30. For example, in the illustrated embodiment, rupture disc 30 may be secured within an expanded diameter portion of housing inner bore 24 defined by downward facing shoulder 80 of housing segment 20 and upper end 82 of housing segment 22 in housing inner bore 24 in the sealed state of the system 10. Rupture disc 30 may include base 84 and central portion 86. Central portion 86 of rupture disc 30 may have a general dome shape. Because of its dome shape, central portion 86 of rupture disc is configured to withstand a higher pressure applied to an outer surface 86*a* than the pressure that an inner surface 86*b* is able to withstand without fracturing. For example, outer surface 86*a* may be able to withstand a pressure in the range of 2,000 psi to 10,000 psi, while inner surface 86*b* is able to withstand a pressure in the range of 500 psi to 2,000 psi.

In some embodiments, such as the illustrated embodiment, the crown of the dome is disposed downstream of base 84 of rupture disc 30. Distal end 88 of base 84 may be positioned against downward facing shoulder 80 of housing segment 20, proximal end 90 of base 84 may be positioned near upper shoulder 82 of housing segment 22, and the crown of central portion 86 of rupture disc 30 may be positioned in housing inner bore 24 within housing segment 22. In these embodiments, rupture disc 30 may be configured to fracture at a lower pressure on its upstream side (inner surface 86*b*) than its downstream side (outer surface 86*a*).

In some embodiments, the dome shape of central portion 86 may include smooth, continuous outer and inner surfaces. In other embodiments, the dome shape of central portion 86 may include an outer surface formed of a plurality of facets defined by a plurality of seams, an inner surface formed of a plurality of facets defined by a plurality of seams, or both outer and inner surfaces formed of a plurality of facets defined by a plurality of seams. For example, in the illustrated embodiment, the dome shape of central portion 86 includes outer surface 86*a* formed of a plurality of facets and inner surface 86*b* that is smooth and continuous. As used herein, "facet" means a flat surface having a constant angular orientation, or a conical surface. As used herein "flat" means a substantially planar surface, which may or may not include insignificant deviations from the plan (e.g., a small bump or similar irregularity). As used herein, "conical surface" means a segment of a surface formed by moving one end of a straight line in a curve or in a circle while the other end of the straight line remains stationary.

Central portion 86 of rupture disc 30 fluidly seals housing inner bore 24 by extending across housing inner bore 24. One or more seals 92 may be positioned between rupture disc 30 and upper end 82 of housing member 22. One or more seals 94 may be positioned within one or more recesses 96 in housing member 22 to further fluidly seal the connection between housing members 20 and 22. In other embodiments, some or no seals are used at all whereby distal end 88 of base 84 of rupture disc 30 may be positioned against downward facing shoulder 80 of housing segment 20, and in this way, the rupture disc 30 fluidly seals housing inner bore 24. Housing segments 20 and 22 may be secured together at interface 98, which may include a threaded inner surface of segment 20 and a threaded outer surface of segment 22. In other embodiments, housing segments 20 and 22 may be secured by any fastening mechanism as readily understood by skilled artisans.

In certain embodiments, an inner surface of base 84 of rupture disc 30 is generally radially aligned with, or is disposed radially outward of, housing inner bore 24 immediately upstream and housing inner bore 24 immediately downstream of base 84. In other words, in these embodiments an inner diameter of base 84 may be equal to or greater than the inner diameter of housing inner bore 24 immediately above and below base 84. For example, in the illustrated embodiment, inner surface 84*a* of base 84 is disposed slightly radially outward of adjacent upstream portion 100 of housing inner bore 24 and adjacent downstream portion 102 of housing inner bore 24. In other words, an inner diameter of base 84 is slightly greater than the inner diameter of adjacent upstream portion 100 and adjacent downstream portion 102 of housing inner bore 24. In this embodiment, base 84 of rupture disc 30 is housed within the expanded diameter portion of housing inner bore 24 formed by shoulder 80 of housing segment 20 and upper end 82 of housing segment 22. In other embodiments, inner surface 84*a* of base 84 may be generally aligned with adjacent upstream portion 100 and/or adjacent downstream portion 102 of housing inner bore 24. In some embodiments, one or more housing segments may include a circumferential recess in the outer surface. For example, circumferential recess 103 may extend around the outer surface of housing segment 20, and circumferential recess 104 may extend around the outer surface of housing segment 22. Identifying information about the tool or job number may be stamped into recesses 103 and 104 where the outer diameter reduction reduces the wear on the stamped information.

Rupture disc 30 may be configured to fracture in response to a rupture event. The rupture event may be application of a pressure within housing inner bore 24 upstream of rupture disc 30 that meets or exceeds a rupture pressure value in the downstream direction on central portion 86 of rupture disc 30. In certain embodiments, the rupture pressure value is in the range of 500 psi and 2,000 psi. Alternatively, the rupture event may be a mechanical or physical force exerted in a downstream direction on the central portion 86 of rupture disc 30. In certain embodiments, intermediate space 106 is filled with air under hydrostatic surface pressure or at a vacuum pressure, and the rupture event is plug 28 mechanically hitting and crushing rupture disc 30. As used herein, "rupture event" means an occurrence that causes a change in the rupture disc that renders the rupture disc incapable of hydraulically sealing the housing inner bore. In embodiments including a plurality of facets on an inner and/or outer surface of central portion 86, rupture disc 30 may be configured to fracture along the plurality of seams in response to the rupture event. In this way, the number and size of the disc fragments generated by the rupture event may be controlled. For example, the plurality of seams may be configured to provide a greater number of smaller disc fragments, which eases the process of clearing the disc fragments from the wellbore.

In the sealed state shown in FIGS. 1, 2, and 4, plug 28 and rupture disc 30 each fluidly seals housing inner bore 24. Intermediate space 106 is formed between within housing inner bore 24 between upper end 34 of housing segment 18 and upper end 82 of housing segment 22. In the sealed state of system 10, plug 28 and rupture disc 30 fluidly seal and isolate an upstream end and a downstream end of intermediate space 106, respectively. In one embodiment, intermediate space 106 may be at atmospheric pressure or at a vacuum pressure.

Figure 6:
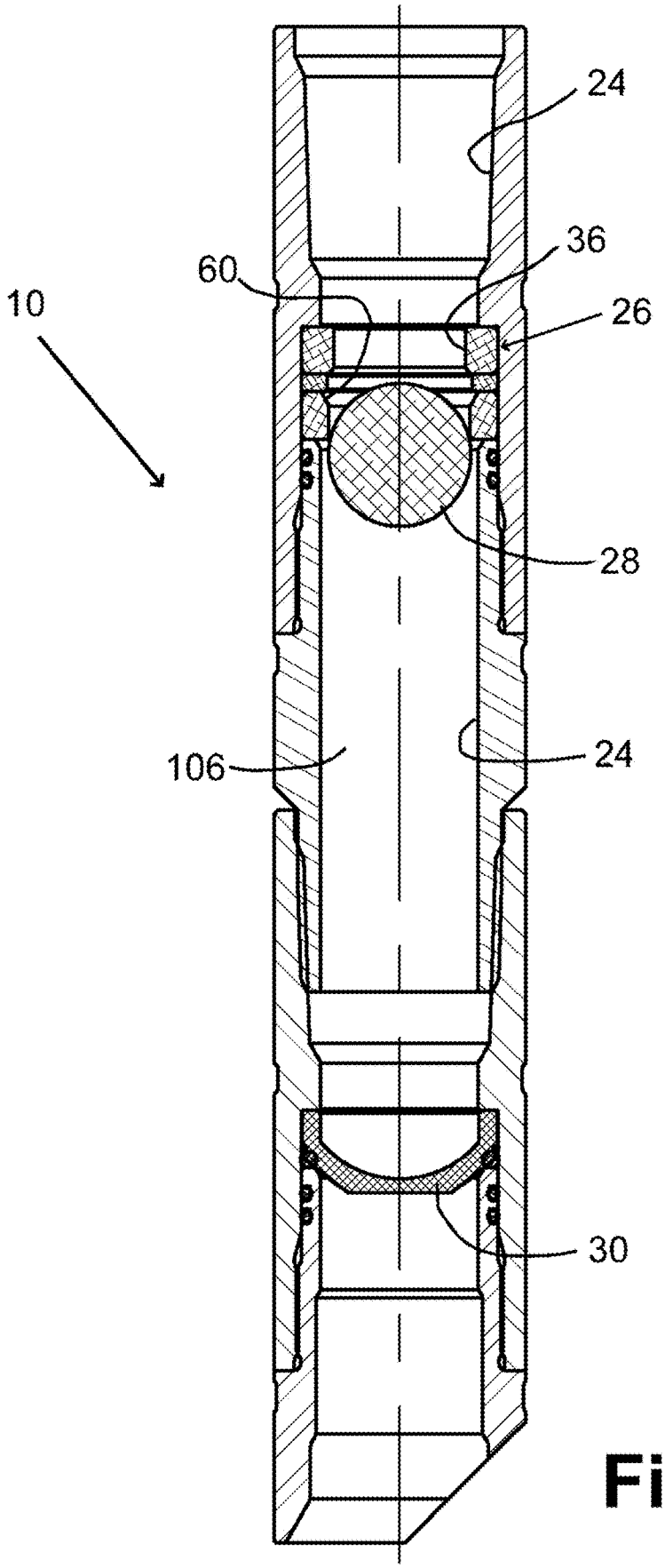
FIG. 6 is a sectional view of the sealing system in a released state.

With reference to FIG. 6, a release event causes the plug 28 to be released from sleeve 26. Once the applied pressure in the downstream direction meets or exceeds the release pressure value, the downstream force overcomes the frictional forces between the plug 28 and tapered surface 60 such that plug 28 is forced in the downstream direction within the sleeve inner bore 36 until plug 28 travels into the intermediate space 106 in a released state illustrated in FIG. 6. Alternatively, once the applied mechanical or physical force in the downstream direction overcomes the frictional forces between plug 28 and tapered shoulder 60, plug 28 is released. In the released state, plug 28 has been released from sleeve 26 and travels into intermediate space 106, while rupture disc 30 continues to fluidly seal housing inner bore 24.

Figure 7:
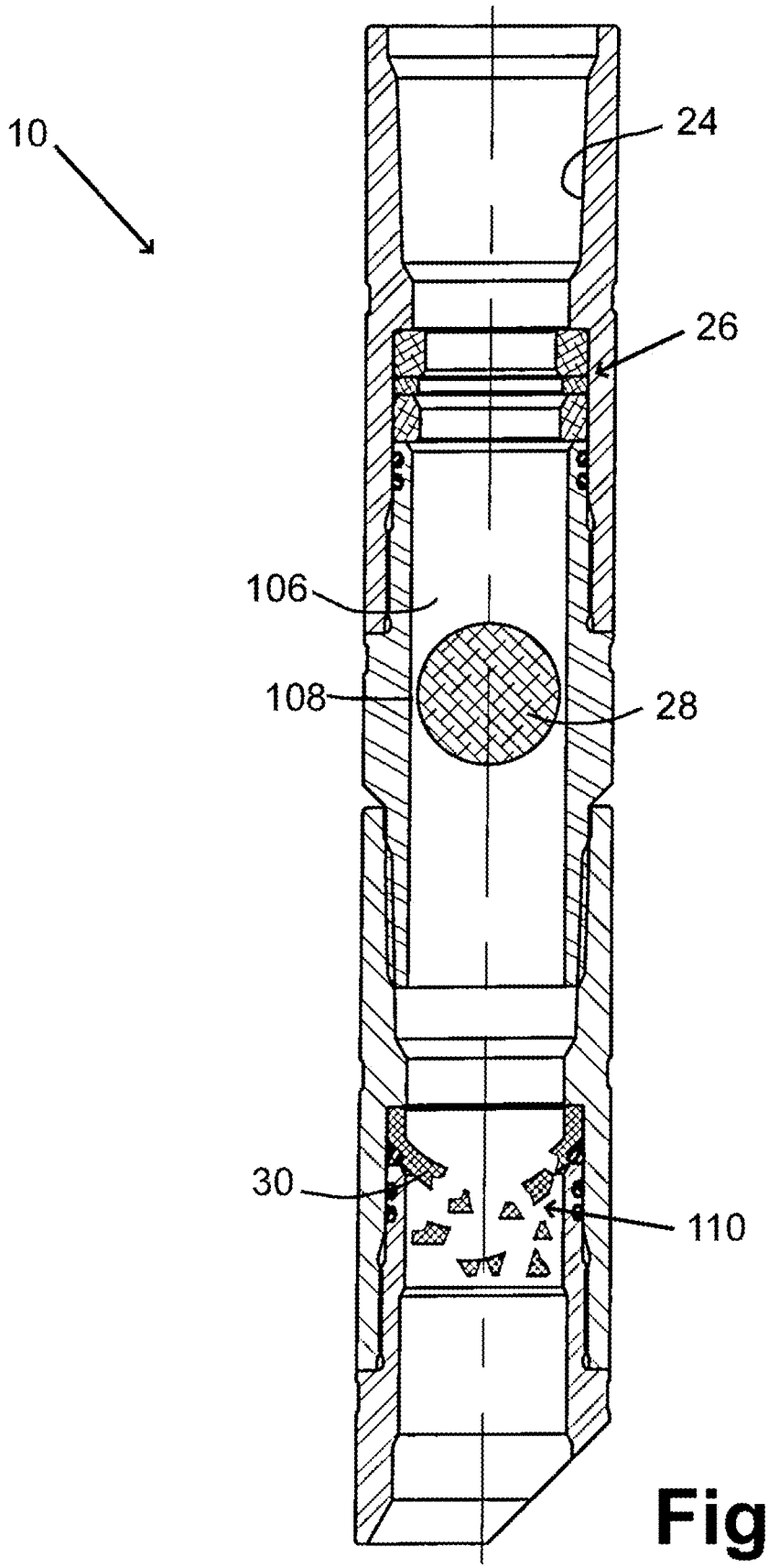
FIG. 7 is a sectional view of the sealing system in a pressure ruptured state.

Referring to FIG. 7, in embodiments in which the outer diameter or outer dimension of plug 28 is less than the inner diameter of housing inner bore 24, annular space 108 opens between plug 28 and housing inner bore 24 as plug 28 travels downstream into intermediate space 106 after being released from sleeve 26. The intermediate space 106 fills up with the pressurized media, which causes an increased fluid pressure to travel ahead of plug 28 through annular space 108 around plug 28. The increased fluid pressure at plug 28 may cause an increased pressure on rupture disc 30 that meets or exceeds the rupture pressure value before plug 28 reaches rupture disc 30. In this way, a rupture event may be created by the increased fluid pressure ahead of the plug 28, which causes central portion 86 of rupture disc 30 to fracture to break the central portion's fluid seal of housing inner bore 24. FIG. 7 illustrates this pressure ruptured state of sealing system 10 in which central portion 86 of rupture disc 30 has fractured into multiple fragments 110 while plug 28 is traveling in the downstream direction within intermediate space 106.

Figure 8:
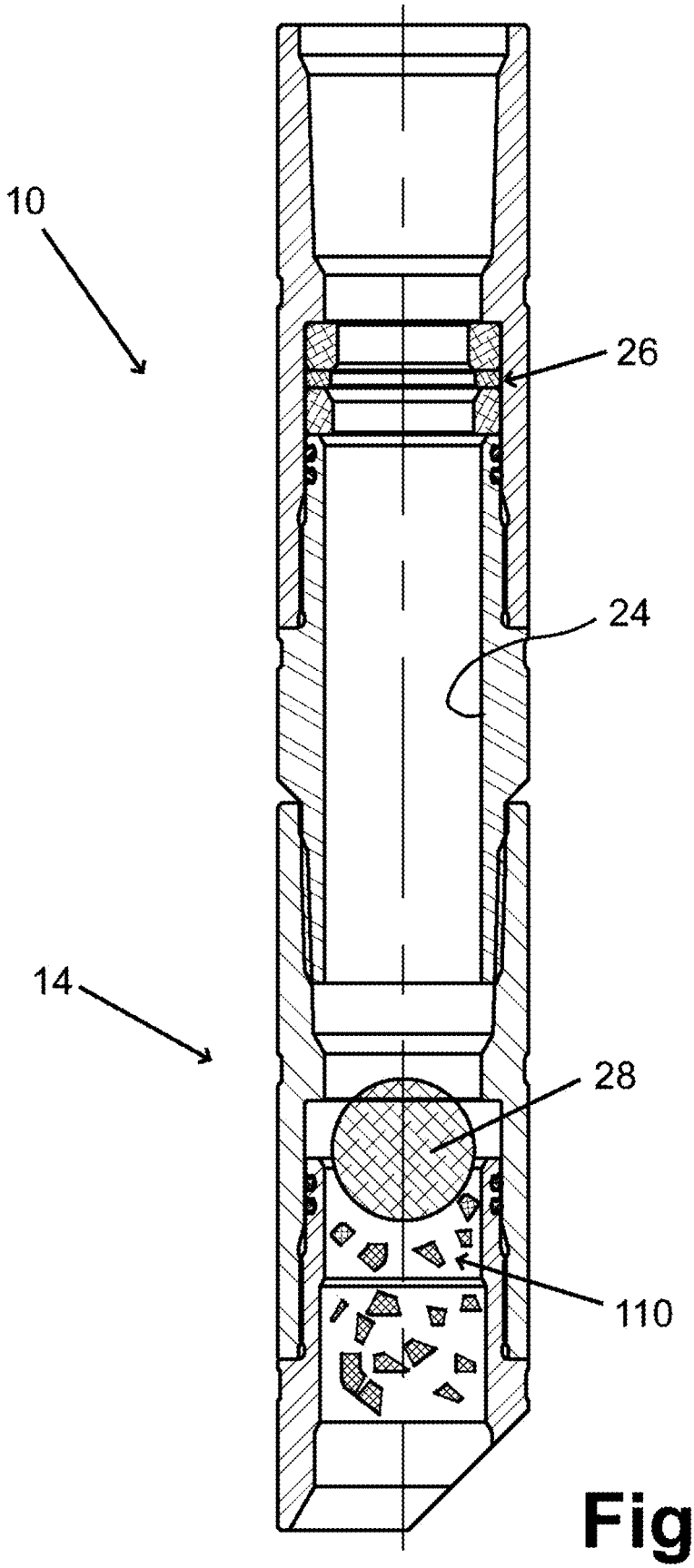
FIG. 8 is a sectional view of the sealing system in a cleaning state.

FIG. 8 illustrates a clearing state of sealing system 10 in which plug 28 pushes fragments 110 of rupture disc 30 downstream within housing inner bore 24 as it travels downstream through the housing inner bore 24 of disc portion 14. When passing through the original position of the rupture disc 30, plug 28 cleans out remaining fractured fragments that may be jammed and/or trapped in the intermediate space 106.

Figure 9:
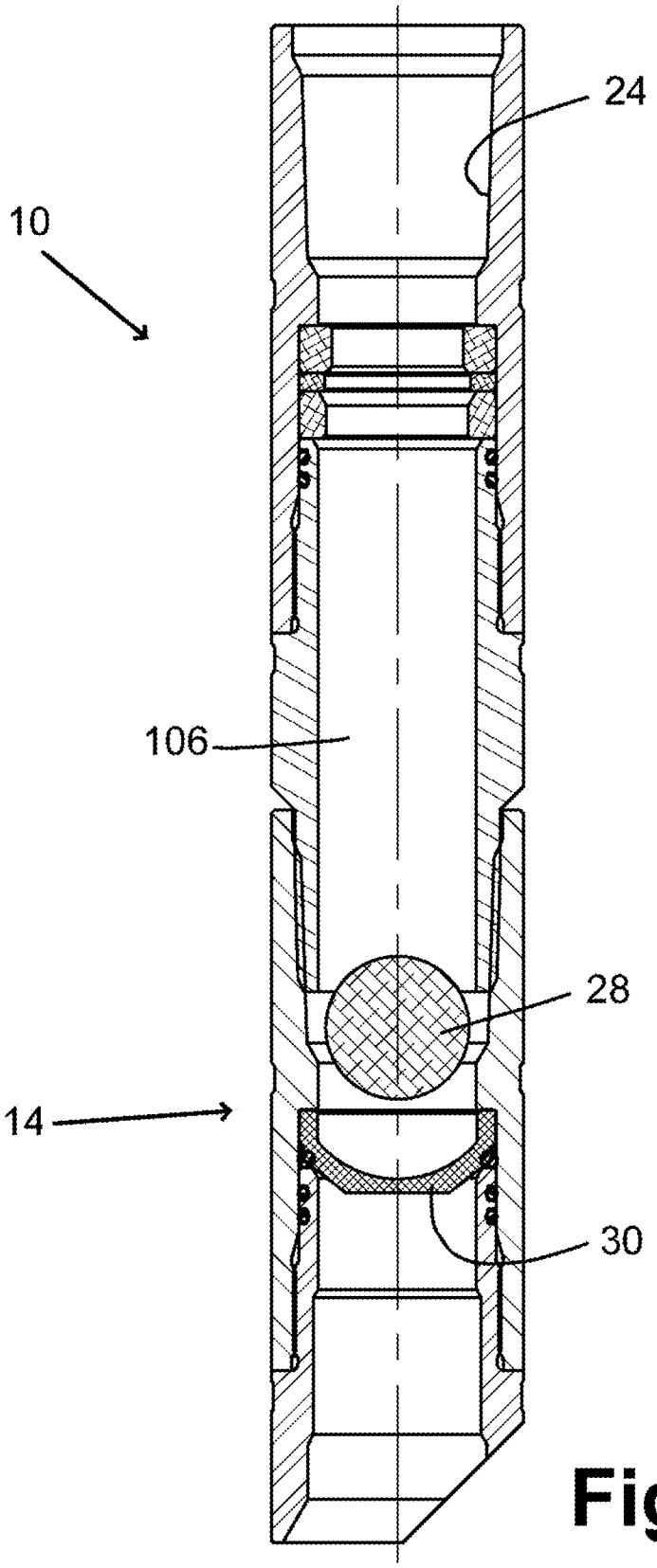
FIG. 9 is a sectional view of the sealing system a plug traveling through an inner bore while a rupture disc seals a downstream portion of the inner bore.
Figure 10:
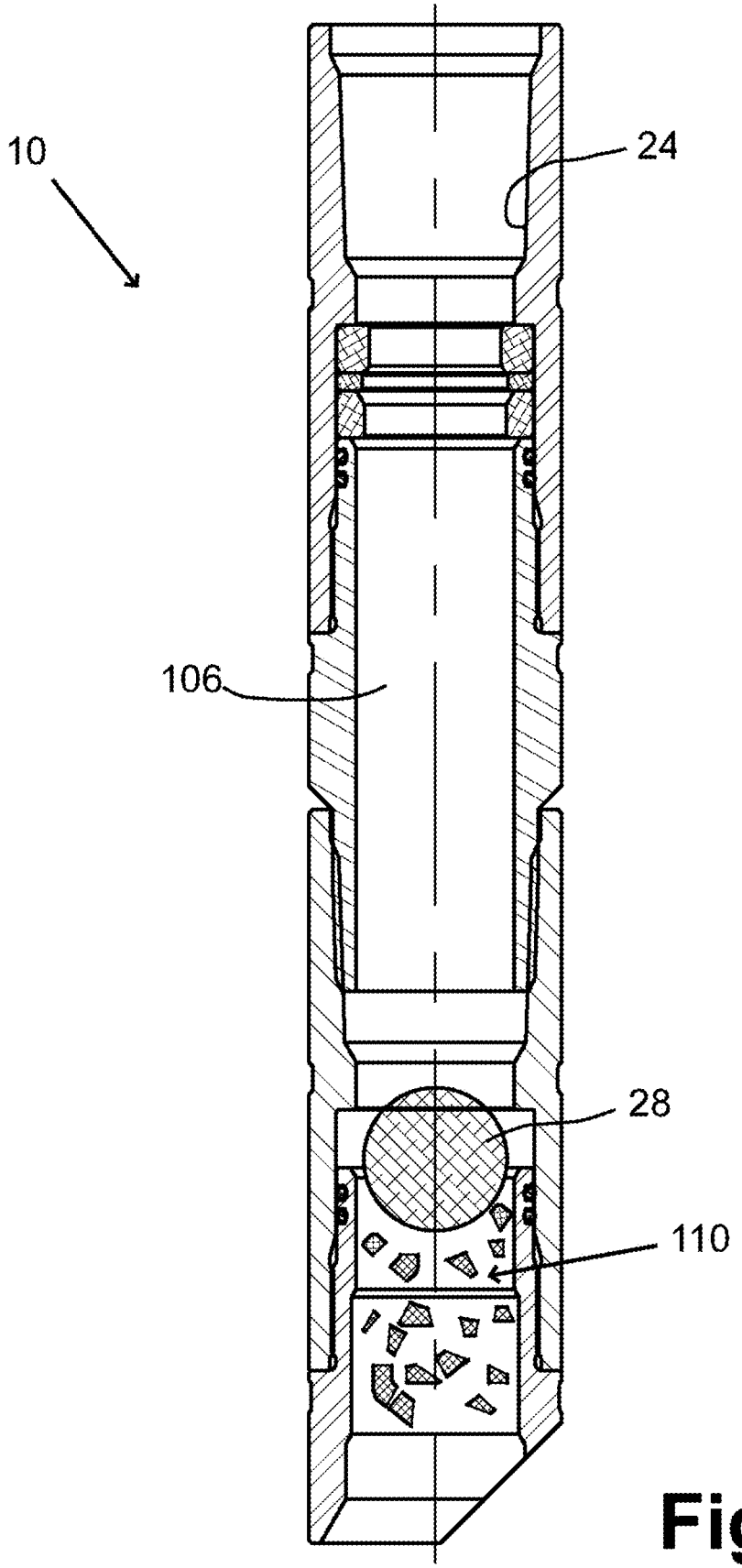
FIG. 10 is a sectional view of the sealing system in a mechanical ruptured state.

FIGS. 9 and 10 illustrate an alternate method of fracturing rupture disc 30. As shown in FIG. 9, sealing system 10 may remain in the released state with rupture disc 30 sealing housing inner bore 24 while plug 28 travels downstream within housing inner bore 24 of disc portion 14. When plug 28 reaches rupture disc 30, plug 28 may apply a mechanical force on rupture disc 30 in the downstream direction that meets or exceeds the rupture pressure value. In this way, the downstream movement of plug 28 may provide the rupture event that causes central portion 86 of rupture disc 30 to fracture into multiple fragments 110. FIG. 10 illustrates this mechanical ruptured state of sealing system 10. In this embodiment, plug 28 pushes fragments 110 downstream as it continues to move downstream through housing inner bore 24.

Figure 11:
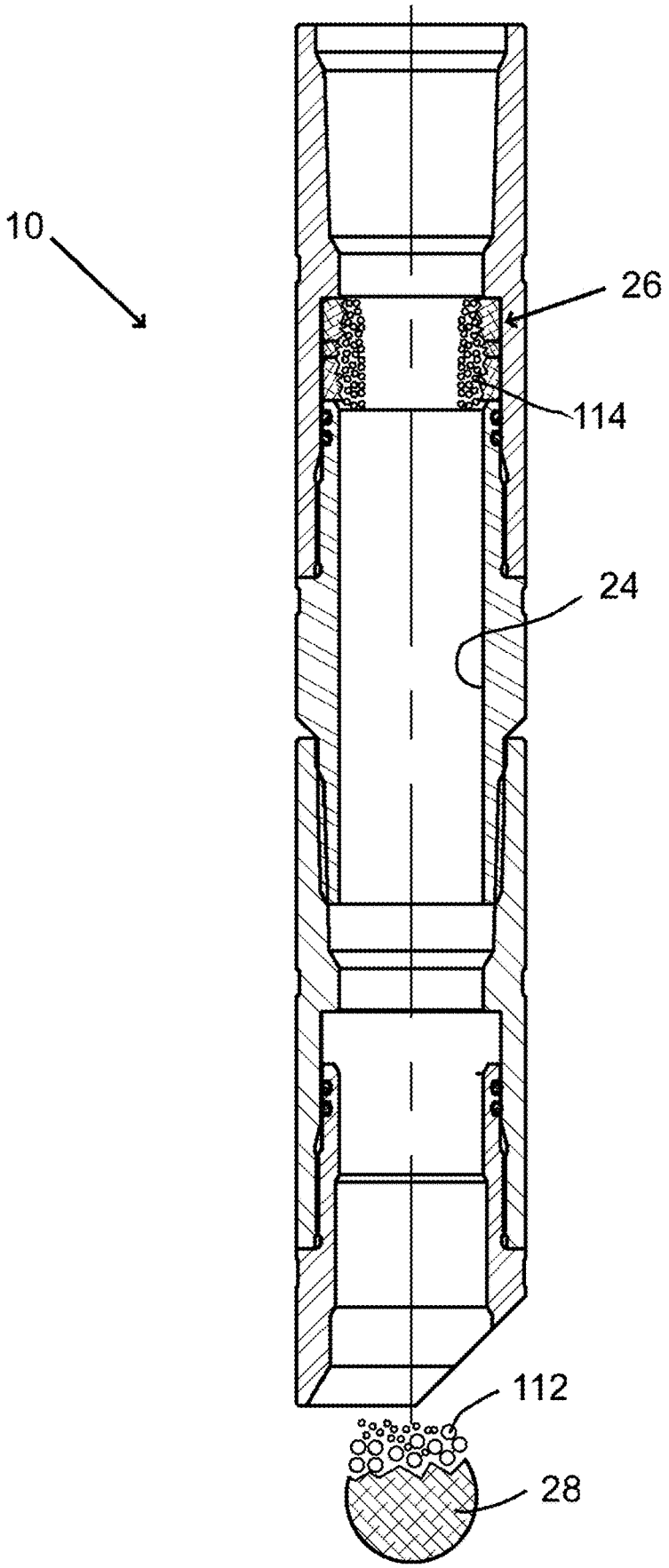
FIG. 11 is a sectional view of the sealing system in a dissolving state.

FIG. 11 illustrates a dissolving state of one embodiment of the sealing system 10. In this embodiment, plug 28 may be formed of any soluble or dissolvable material that is capable of being dissolved or otherwise broken down by at least one fluid, such as dissolvable magnesium, zinc alloy, polylactic acid (PLA), polyvinyl alcohol (PVA), or any other dissolvable material. After being released from sleeve 26, dissolvable plug 28 of this embodiment may be dissolved or suspended as particles 112 in a dissolving or suspending agent. Additionally, sleeve 26 may be formed of any soluble or dissolvable material that is capable of being dissolved or otherwise broken down by at least one fluid, such as dissolvable magnesium, zinc alloy, polylactic acid (PLA), polyvinyl alcohol (PVA), or any other dissolvable material. Sleeve 26 may dissolve or suspend as particles 114 in the dissolving or suspending agent when introduced. Additionally, rupture disc 30 may be formed of any soluble or dissolvable material that is capable of being dissolved or otherwise broken down by at least one fluid, such as dissolvable magnesium, zinc alloy, polylactic acid (PLA), polyvinyl alcohol (PVA), or any other dissolvable material. Fragments 110 of rupture disc 30 (shown in FIGS. 7, 8, and 10) may dissolve or suspend as particles in the dissolving or suspending agent when introduced. The dissolvable components may dissolve in 4-6 hours.

Figure 12:
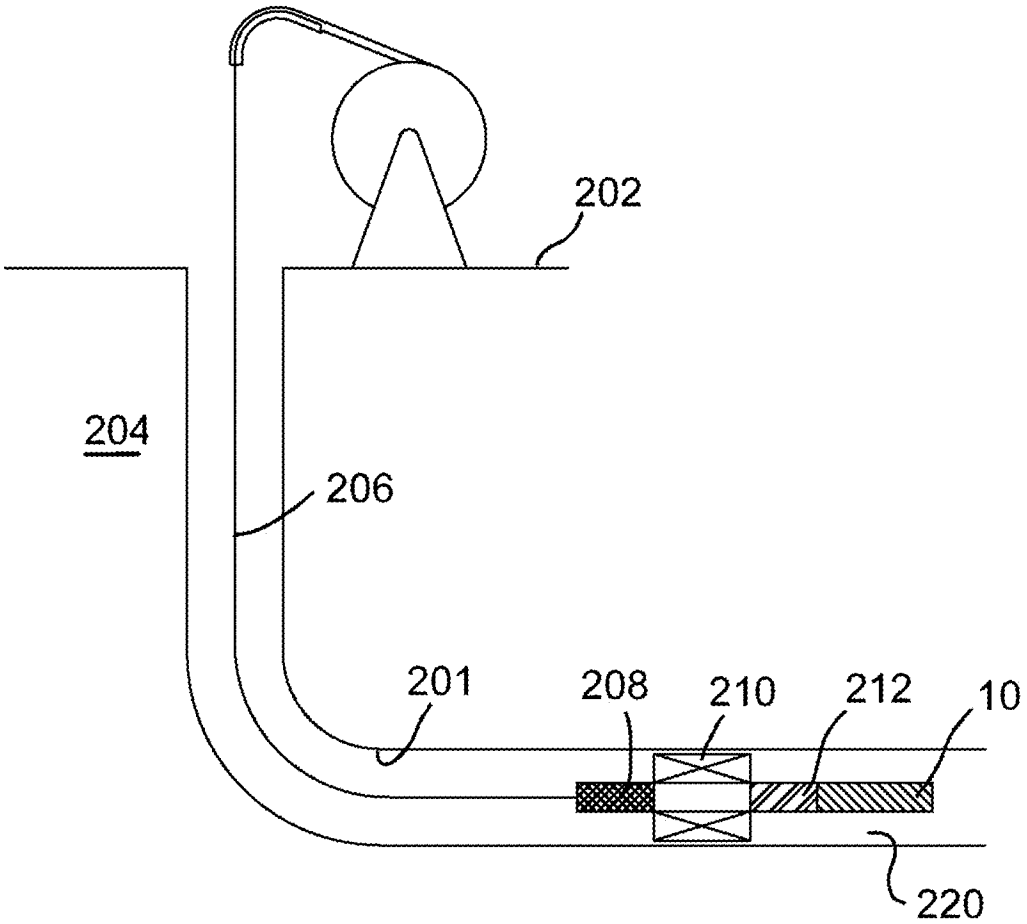
FIG. 12 is a plan view of the sealing system positioned in a wellbore using a coiled tubing string.

With reference now to FIG. 12, sealing system 10 may be set in wellbore 201 extending below surface 202 through subterranean formation 204 using coiled tubing string 206. Wellbore 201 may be configured as an underbalanced well. Sealing system 200 may be secured to a distal end of coiled tubing string 206 with coiled tubing connector 208, packer or frac plug 210, and pup joint 212 secured between distal end of coiled tubing string 206 and the proximal end of sealing system 10. Sealing system 10 in the sealed state and packer or frac plug 210 may be set within wellbore 201 to fluidly seal distal portion 220 of wellbore 201 from surface 202. While in the sealed state, sealing system 10 may withstand higher pressure "kicks" from downstream fluids with a lower release pressure value required to release plug 28. For example, without limiting the scope of this disclosure, rupture disc 30 may withstand a downstream pressure of up to 10,000 psi applied on the outer surface 86*a* of central portion 86 of rupture disc 30.

When a user desires to restore fluid communication between distal portion 220 of wellbore 201 and surface 202, the user may create a release event to release plug 28 from sleeve 26. In one embodiment, the release event may be created by pumping a fluid into wellbore 201 to apply a pressure on plug 28 that meets or exceeds the release pressure value. For example, a fluid may be pumped into wellbore 201 to apply a pressure in the range of 500 psi to 2,000 psi to the upstream side of plug 28. Alternatively, the release event may be created by applying a mechanical or physical force on the plug 28 that exceeds the relevant frictional forces. With both types of release events, the release of plug 28 may in turn trigger a rupture event to fracture the central portion 86 of rupture disc 30 into a plurality of fragments 110 as described herein. Plug 28 clears the plurality of fragments 110 from the housing inner bore 24 of sealing system 10. Plug 28, sleeve 26, and/or the plurality of fragments 110 of rupture sub 30 may dissolve or be suspended in a dissolving or suspending agent. In this way, sealing system 10 enables selectively sealing an isolated portion of a wellbore and selectively reestablishing fluid communication between the isolated portion of the wellbore and the surface without the need to retrieve components of seal system 10.

Figure 13:
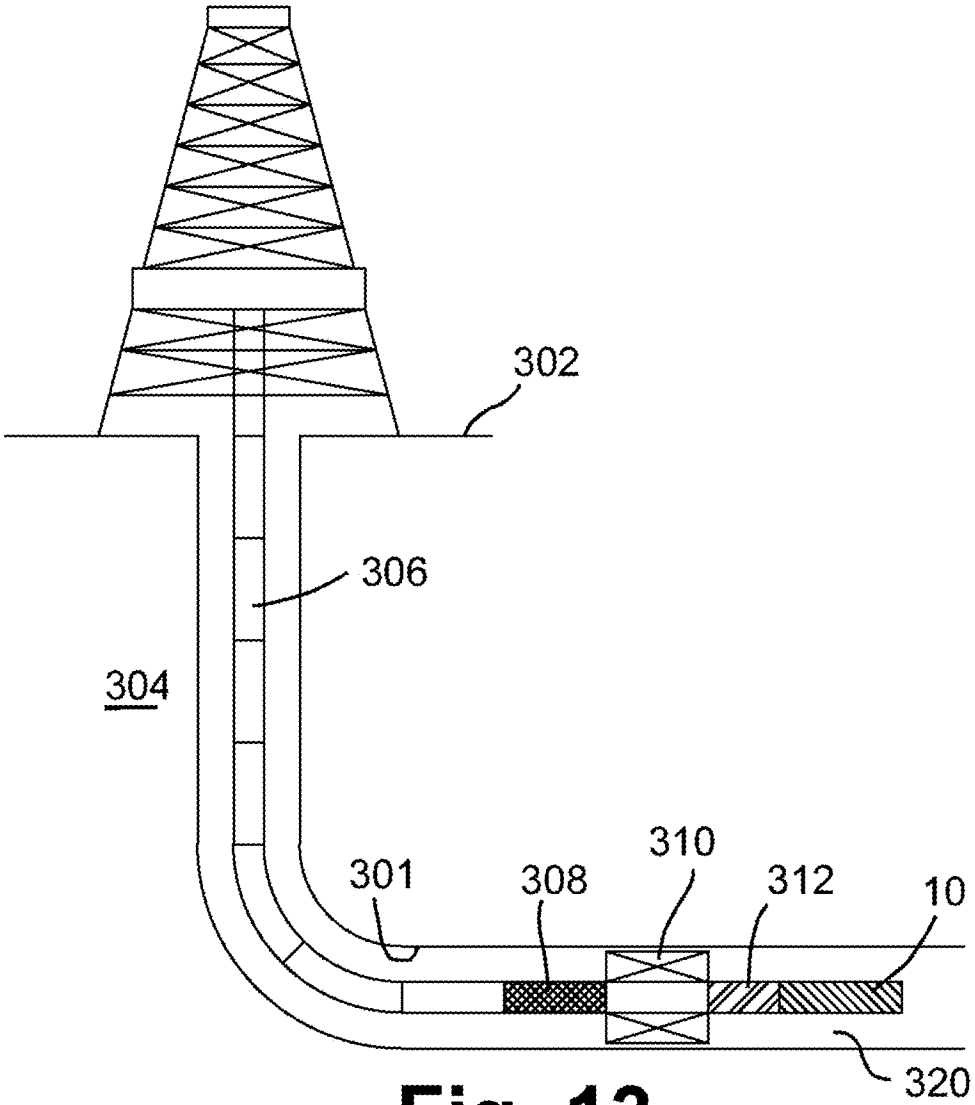
FIG. 13 is a plan view of the sealing system positioned in a wellbore using a tubular string.

Referring to FIG. 13, sealing system 10 may be set in wellbore 301 extending below surface 302 through subterranean formation 304 using tubular drill pipe string 306. Wellbore 301 may be configured as an underbalanced well. Sealing system 10 may be secured to a distal end of tubular string 306, with crossover 308, packer or frac plug 310, and pup joint 312 secured between the distal end of tubular string 306 and the proximal end of the sealing system 10. Sealing system 10 and packer or frac plug 310 may be set within wellbore 301 to fluidly seal distal portion 320 of wellbore 301 from surface 302. When a user desires to restore fluid communication between distal portion 320 of wellbore 301 and surface 302, the user may create a release event to release plug 28 from sleeve 26. The release event may be any of the events described above, including but not limited to, application of a fluid pressure on plug 28 that meets or exceeds a predefined release pressure value, application of a mechanical or physical force on plug 28.

Except as otherwise described or illustrated, each of the components in this device has a generally cylindrical or tubular shape and may be formed of steel, another metal, or any other durable material. Portions of sealing system 10 may be formed of a wear resistant material, such as tungsten carbide or ceramic coated steel.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A system for fluidly sealing a portion of a wellbore, comprising:

a housing including a housing inner bore, the housing configured for direct axial connection to a distal end of a coiled tubing string or a drill pipe string;

a rupture disc disposed within the housing inner bore, the rupture disc including a base and a central portion, wherein the central portion extends entirely across the housing inner bore and fluidly seals the housing inner bore in a sealed state;

a plug disposed within the housing inner bore, wherein the plug fluidly seals the housing inner bore in the sealed state, wherein the plug is disposed an axial distance from the rupture disc in the sealed state.

2. The system of claim 1, further comprising a sleeve disposed within the housing inner bore, the sleeve including a sleeve central bore and a downstream retainer adjacent to the sleeve central bore; wherein the plug is retained in the sleeve central bore in the sealed state.

3. The system of claim 2, wherein the sleeve is separated from the rupture disc by an axial distance of about 0.5 inch to about 12 inches.

4. The system of claim 2, wherein the rupture disc is disposed downstream of the sleeve.

5. The system of claim 4, wherein the sleeve is configured to release the plug in response to a release event.

6. The system of claim 5, wherein the release event includes application of a release pressure value; wherein the release pressure generates a value of 95% or less of an overpull to failure in the weakest cross-sectional area of the housing.

7. The system of claim 5, wherein the rupture disc is configured to fracture into a plurality of fragments in response to a rupture event when the plug is released from the sleeve.

8. The system of claim 7, wherein the plug is configured to mechanically clear the plurality of fragments of the rupture disc from the housing inner bore.

9. The system of claim 2, wherein the downstream retainer of the sleeve is a tapered surface.

10. The system of claim 2, wherein the downstream retainer of the sleeve is a convex surface.

11. The system of claim 2, wherein the downstream retainer of the sleeve is a concave surface.

12. The system of claim 2, wherein the plug is a dissolvable ball and the downstream retainer of the sleeve is a ball seat.

13. The system of claim 12, wherein the sleeve is dissolvable.

14. The system of claim 2, wherein the sleeve is formed of two or more rings.

15. The system of claim 14, wherein the sleeve includes an upstream ring and a downstream ring; wherein the upstream ring includes an upstream retainer for the plug; and wherein the downstream ring includes a downstream retainer for the plug.

16. The system of claim 15, wherein the sleeve further includes a trim spacer disposed between the upstream ring and the downstream ring.

17. The system of claim 2, wherein the central portion of the rupture disc includes a dome shape.

18. The system of claim 17, wherein an outer surface and an inner surface of the dome shape are each formed of a continuous surface.

19. The system of claim 17, wherein an outer surface and an inner surface of the dome shape are formed of a plurality of facets defined by a plurality of seams.

20. The system of claim 17, wherein a first surface of the dome shape is formed of a continuous surface; wherein a second surface of the dome shape is formed of a plurality of facets defined by a plurality of seams.

21. The system of claim 17, wherein the rupture disc is dissolvable.

22. A method of selectively sealing a portion of a wellbore, comprising the steps of:

a) providing a sealing system comprising: a housing including a housing inner bore, the housing configured for direct axial connection to a distal end of a coiled tubing string or a drill pipe string; a rupture disc disposed within the housing inner bore, the rupture disc including a base and a central portion, wherein the central portion extends entirely across the housing inner bore and fluidly seals the housing inner bore in a sealed state; a sleeve disposed within the housing inner bore, the sleeve including a sleeve central bore and a downstream retainer adjacent to the sleeve central bore; and a plug retained within the sleeve central bore to fluidly seal the housing inner bore in the sealed state; wherein the sleeve is disposed an axial distance from the rupture disc;

b) positioning the rupture disc system in the sealed state within the wellbore to fluidly seal the portion of the wellbore;

c) generating a release event to release the plug from the sleeve central bore;

wherein the plug travels downstream into an intermediate space between the sleeve and the rupture disc;

d) triggering a rupture event to fracture the central portion of the rupture disc into a plurality of fragments;

e) optionally clearing the plurality of fragments of the rupture disc from the housing central bore with the plug.

23. The method of claim 22, wherein in step (c) the release event is application of an increased pressure that meets or exceeds a release pressure value on an upstream portion of the plug.

24. The method of claim 23, wherein in step (d) the rupture event is application of the increased pressure on an upstream surface of the central portion of the rupture disc while the plug travels through the intermediate space; wherein the increased pressure further meets or exceeds a rupture pressure value of the rupture disc.

25. The method of claim 23, wherein in step (d) the rupture event is a mechanical force in a downstream direction applied by the plug on the upstream surface of the central portion of the rupture disc.

26. The method of claim 22, wherein in step (c) the release event is a mechanical force in a downstream direction applied on an upstream portion of the plug.

27. The method of claim 22, further comprising the step of:

f) dissolving the plug and the sleeve in a fluid.

28. The method of claim 22, wherein in the sealed state the intermediate space between the plug and the rupture disc is at atmospheric pressure or a vacuum.

* * * * *